US005441783A

United States Patent [19]

Silgailis et al.

[11] Patent Number: 5,441,783

[45] Date of Patent: Aug. 15, 1995

[54] EDGE COATING FOR AMORPHOUS RIBBON TRANSFORMER CORES

[75] Inventors: John Silgailis, Cedar Grove; Mark Rand, Chester, both of N.J.

[73] Assignee: AlliedSignal Inc., Morris Township

[21] Appl. No.: 977,378

[22] Filed: Nov. 17, 1992

[51] Int. Cl.[6] ..... H01F 41/00

[52] U.S. Cl. ..... 428/37; 428/98; 428/246; 428/221; 428/398; 428/400; 428/416; 336/213

[58] Field of Search ..... 428/98, 246, 221, 398, 428/400, 416, 37; 336/213

[56] References Cited

U.S. PATENT DOCUMENTS 4,001,198 1/1977 Thomas .
4,615,106 10/1986 Grimes et al. .
4,648,929 3/1987 Siman .
4,707,678 11/1987 Siman .
4,709,471 12/1987 Valencic et al. .
4,734,975 4/1988 Ballard et al. .
4,741,096 5/1988 Lee et al. .
4,789,849 12/1988 Ballard et al. .
4,790,064 12/1988 Ballard et al. .

*Primary Examiner*—Patrick J. Ryan
*Assistant Examiner*—Richard D. Weisberger

[57] ABSTRACT

The present invention relates to a process for edge coating amorphous ribbon transformer cores comprising the steps of applying to at least one face exclusive of the distributed gap portion, a first porous material having a porosity sufficient to permit a liquid having a viscosty greater than about 100,000 cps to impregnate the porous material to produce a composite structure; and applying a bonding material having a viscosity of at least about 100,000 cps to the first porous material such that the bonding material substantially contacts the core. Coated cores having good magnetic properties are also disclosed.

10 Claims, 1 Drawing Sheet

EDGE COATING FOR AMORPHOUS RIBBON TRANSFORMER CORES

BACKGROUND OF THE INVENTION

1. Field of the Invention

The present invention relates to a process for coating amorphous ribbon transformer cores and the cores produced thereby. The process utilizes high viscosity bonding material and a support material having a porosity sufficient to allow said bonding material to seep therethrough. The coatings of the present invention impart greater strength to the coated core than previously used coatings, simplify the coating process and minimize the risk of bonding penetration into the core laminations.

2. Description of the Prior Art

Transformer cores are commonly manufactured using silicon steel strips as the magnetic core material. Such cores are rigid, hold their shape and are not very stress sensitive. Alternatively, magnetic cores may be made of amorphous ribbon. While such cores possess improved magnetic properties they are more flexible and require more careful handling during transformer manufacture. Improper handling can lead to ribbon deformation or ribbon sliding and induces mechnical stresses, which results in loss of structural integrity and degradation of magnetic properties. To prevent movement of ribbons and increase rigidity, amorphous ribbon cores have been encapsulated or edge coated.

U.S. Pat. No. 4,789,849 discloses distributed joint amorphous metal transformer cores having lateral edges which are coated with an adhesive bonding agent. No support material is disclosed.

U.S. Pat. No. 4,648,929 discloses a method for producing magnetic cores coated with the composite conformal coating which includes foraminous or porous material, and at least one coat of a UV curable resin. The resin has a low viscosity and the porous material is selected to prevent the resin from passing through the porous material in an effort to prevent penetration between the laminations, which results in degradation of the magnetic properties of the coated core.

U.S. Pat. No. 4,707,678 discloses magnetic cores having a composite conformal coating including a low stress insulative layer having a foraminous insulative sheet impregnated with a first gelled resin bonded to the core edges and bonded to the low stress layer, a high strength structure having at least one insulative layer impregnated with a second resin having higher tensile strength than the first gelled resin. As with the '929 patent, the resin has a low viscosity and the foraminous insulative sheet is selected to prevent the resin from passing through the porous material in an effort to prevent penetration between the laminations.

The UV curable resins of the prior art are low viscosity materials which shrink in volume when cured, causing mechanically induced stresses in the laminations which result in degradation of the magnetic properties of the core. Thus, careful coating and immediate curing are required. Moreover, the foraminous or porous sheets must be very densely woven (cloth-like) to prevent wicking and consequently reduce the range of materials which may be used. The materials of the prior art tend to be fabric-like and would prevent the high viscosity bonding materials of the present invention from wicking through to the core edge.

DETAILED DESCRIPTION OF THE INVENTION

Figure 1:
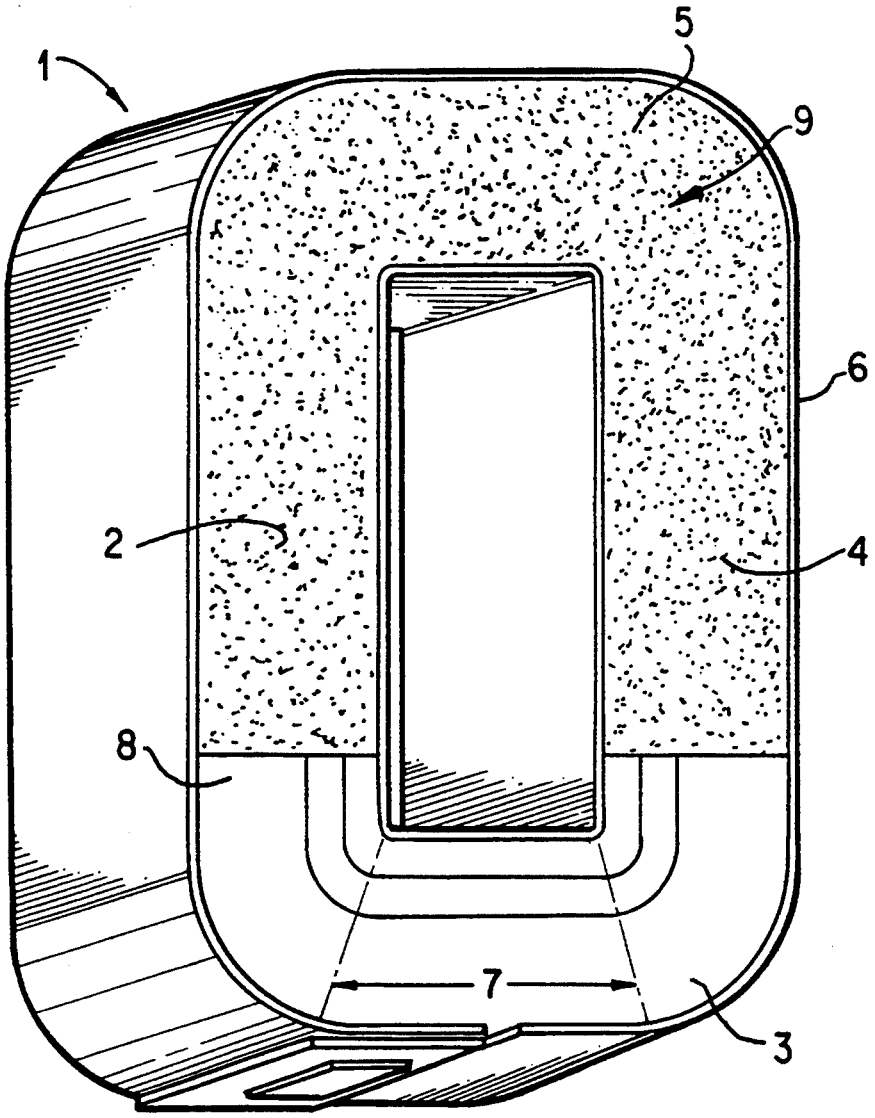
FIG. 1 is an elevation view of a magnetic core.

The present invention is directed to a process for edge coating amorphous ribbon transformer cores and to the coated cores produced thereby. The process of the present invention comprises the steps of:

providing a core comprising a plurality of layers of amorphous alloy strip, arranged such that the core has two edges, oriented such that the edges define top and bottom faces, each face having a discontinuity defining be a distributed gap portion extending from the top face to the bottom face; applying to at least one face exclusive of the distributed gap portion, a first porous material having a porosity sufficient to permit a liquid having a viscosity greater than about 100,000 cps to impregnate the support material to produce a composite structure;

and applying a bonding material having a viscosity of at least about 100,000 cps to the first porous material such that the bonding material at least partially encapsulates the first porous material and substantially contacts the core.

The process of the present invention requires fewer steps and precautions to produce mechanically stable cores. Because the first porous material of the present invention must permit substantial permeation of high viscosity bonding materials, relatively coarsely woven porous material is used in place of the fabric-like backings used prior to the present invention. Moreover, the present invention eliminates the need for a low stress first coat of the prior art. However, the coatings of the present invention are compatible with and may be used over low-stress first coats, such as first coats of white glue or rubbery, easily breakable adhesives.

Cores which may be coated according to the present invention are distributed gap cores which may be made by any method known in the art such as disclosed in U.S. Pat. Nos. 4,789,849 (Column 3, line 36—column 5, line 32), 4,741,096, 4,734,975 (Column 3 line 40—Column 5, line 36) and 4,709,471.

FIG. 1 shows a typical distributed gap core 1 having leg portions 2 and 4, and yoke portions 3 and 5 formed from amorphous alloy strip laminations 8. Usually a distributed gap 7 is formed in a yoke portion of the core. Typically, the distributed gap is formed by staggered overlapping of the ends of the amorphous alloy strip laminations. As illustrated the core is supported by a band of ferromagnetic material 6 such as silicon steel to maintain the core in the illustrated configuration. The "face" of the core shown in FIG. 1 is defined by the edges of the laminations 8.

Typically the core shown in FIG. 1 would be supported in its final shape during the anneal and coating steps. In the first step a first porous material having a porosity sufficient to permit a liquid having a viscosity greater than about 100,000 cps to impregnate the first porous material is applied to at least one face (exclusive of the distributed gap portion) of the core. If the core is to be used in oil the first porous material must also be stable in and compatible with oil. The first porous material is cut to fit over the legs and non-jointed yoke sections of the core. Excess may be trimmed off or folded over the edge, and flattened against the sides of the core. When coated, the first porous material acts as a reinforcement in the composite coating 9 which is formed. Thus, porous materials having high mechanical strength are preferred, as they increase the strength of the resulting composite coating and impart increased mechanical stability to the resulting core. Mesh or net materials are particularly suitable. Preferably the porous material has strands which are between about 2 and about 20 mils in diameter, and most preferably between about 5 and about 10 mils in diameter. The weave density may vary so long as it is sufficiently loose to permit the high viscosity bonding material to seep through and to provide the high mechanical strength porous material with a relatively smooth surface. Accordingly, coarsely woven porous material is preferred. More preferably the weave of the first porous material is between about 2 to about 100 strands per linear inch, and most preferably between about 5 to about 15 strands per linear inch. Suitable first porous materials include, but are not limited to cotton gauze and glass mesh. Because of the coarse weave porous materials of the present invention act as mechanical reinforcements bonded within the bonding material and not as control mechanisms which limit the flow of bonding material to the core edge.

A high viscosity bonding material is applied over the first porous material. The bonding material must be compatible with the core and the first porous material and capable of penetrating through the coarsely woven porous material without substantial wicking between the core laminations. Accordingly, bonding materials having a viscosity above about 100,000 cps are preferred. Preferably the bonding material is an epoxy, more preferably an epoxy having a viscosity of greater than about 700,000 cps and most preferably a thixotropic epoxy, such as APC 929 HT gel.

The amount of bonding material applied must be sufficient to adhere the porous material to the core, but insufficient to result in substantial wicking between the laminations of the core. Accordingly, the bonding material must bond well with both the porous material and the amorphous metal core.

Complex curing steps such as UV curing are unnecessary to set the bonding materials of the present invention. Accordingly, the present invention provides a simplified method for providing increased mechanical strength to amorphous alloy cores with substantially reduced risk of degradation of the mechanical properties thereof.

The bonding and porous material may be applied to core edges which are untreated, or which have been precoated with a first bonding material to form a low stress first coat. The first bonding material should dry quickly, as wicking of the first bonding material between the laminations of the core degrades the magnetic properties of the core. Any suitable bonding agent may be used as the first bonding material. White glue is a particularly useful first bonding material as it is easy to apply and dries quickly. The first bonding material is applied to legs and non-jointed yoke sections of the core edge. Preferably both the top and bottom edges of the core are coated. If the first bonding material is a flexible rubbery compound, it can be applied to all sections of the core, including the joint. Alternatively, the first bonding material may be applied only to the jointed section including the distributed gap portion.

Optionally at least one portion of the core other than the distributed gap portion may be left either entirely uncoated, or covered with only a second porous material which may be the same as or different from the first porous material. These uncoated or covered portion(s) may take the form of a strip across at least one face or of at least one small section on at least one face of the core. Preferably the portion(s) are sufficient to increase the rate of oil impregnation between core laminations without substantially decreasing the mechanical stability of the coated core.

EXAMPLE 1

Two cores (about 5 inch by 10 inch window, 3.15 inches thick, weighing about 180 pounds) of 6.7 inch wide Metglas® TCA were edge coated. A layer of glass mesh support material (5 mil fiberglass strands, about 10 strands per inch, commercially available from Permaglass Mesh Co., of Dover, Ohio) having an adhesive side was placed adhesive side down on one core (Core 1). The mesh has 9 strands per inch of polyester coated glass fibers in each direction, and was between about 8 and 10 mils thick with openings spaced about one every 3/32 inch on the edge.

A single coat 0.1 gm/cm$^2$ of APC 929 HT thixotropic epoxy (commercially available from Elsworth Adhesive Systems, Audubon Pa.) was applied on top of the polyester fiberglass applied on core 1, and was applied directly to the top edge of core 2 without the Fiberglass support material. The epoxy was easier to apply to core 1 because the mesh provided a smooth surface allowing easy working of the epoxy.

The core loss was measured for each core at 60 Hz and varying magnetic induction, B and is given in Table 1, below. Both cores displayed slightly decreased power loss after coating., indicating that the epoxy did not penetrate into the core despite the coarse weave of the mesh used. The epoxy coating on Core 2 (no support material) split readily. Core 1 did not split, indicating the improved strength from the addition of the support material.

TABLE 1

| B | CORE LOSS (watts) | | | |
|---|---|---|---|---|
| | CORE 1 Glass Mesh & Epoxy | | CORE 2 Epoxy Only | |
| (Tesla) | uncoated | coated | uncoated | coated |
| 1.3 | 19.4 | 17.2 | 24.2 | 23.4 |
| 1.4 | 22.7 | 19.9 | 27.3 | 26.2 |

EXAMPLE 2

The magnetic properties and core rigidity of cores coated according to the current invention were tested with and without a low-stress first coat. The magnetic properties of two cores (same size and weight as Example 1) were measured at 60 Hz and varying magnetic induction, B. The properties of Cores 3 and 4 are in Table 2, below.

A layer of glass mesh was applied to Core 3, as in Example 1 (Core 1). A single coat of Elmer's white Glue was applied to Core 4. After the glue dried, glass mesh was applied to Core 4 as in Example 1. A single coat of APC 929 HT epoxy (0.1 gm/cm$^2$) was applied to each core. The magnetic properties of the uncoated and coated cores were measured and are shown in Table 2, below.

TABLE 2

| B (Tesla) | Core Loss (watts) Core 3 Glass mesh & Epoxy uncoated | Core 3 coated | Core 4 Precoated uncoated | Core 4 coated |
|---|---|---|---|---|
| 1.3 | 19.2 | 19.0 | 24.6 | 23.1 |
| 1.4 | 23.3 | 23.0 | 29.5 | 27.7 |

The core loss of each coated core is virtually identical to its core loss before coating. Thus, the coatings of the present invention do not degrade the magnetic properties of the cores.

Both cores 3 and 4 could be handled without permanent deformation. Thus, the coatings of the present invention provide mechanical stability to the core without degrading the magnetic properties.

We claim:

1. A magnetic core comprising:

a plurality of layers of amorphous alloy strip, arranged such that the core has two edges, oriented such that the edges define top and bottom faces, each face having a discontinuity defining a distributed gap portion extending from the top face to the bottom face; and a coating, applied to at least one face of the core exclusive of the distributed gap portion, the coating comprising a first porous material having a porosity sufficient to permit a liquid having a viscosity greater than about 100,000 cps to impregnate the first porous material and a bonding material having a viscosity of at least about 100,000 cps applied to the first porous material such that the bonding material substantially contacts the at least one face of the core.

2. The core of claim 1 wherein the first porous material comprises strands of fiber and has between about 2 to about 100 strands per linear inch.

3. The core of claim 2 wherein the first porous material has about 5 to about 15 strands per linear inch.

4. The core of claim 2 wherein the fibers have a diameter between about 2 and about 20 mils.

5. The core of claim 3 wherein the fibers have a diameter between about 5 and about 10 mils.

6. The core of claim 2 wherein the bonding material has a viscosity greater than about 700,000 cps.

7. The core of claim 6 wherein the bonding material is a thixotropic epoxy.

8. The core of claim 1 wherein at least one strip or section on at least one face of the core exclusive of the distributed gap portion is uncoated or is covered with a porous material which is the same as or different from the first porous material.

9. The core of claim 1 wherein both faces including the distributed gap portion of the edge coated core are coated with a rubbery, easily breakable adhesive coating.

10. The core of claim 9 wherein at least one strip or section on at least one face of the core exclusive of the distributed gap portion is uncoated or is covered with a porous material which is the same as or different from the first porous material.

* * * * *